US006792231B2

(12) United States Patent
Maier et al.

(10) Patent No.: US 6,792,231 B2
(45) Date of Patent: Sep. 14, 2004

(54) DEVICE FOR INSERTING A BAND INTO A MACHINE UNIT

(75) Inventors: Stefan Maier, Poing (DE); Uwe Milling, Munich (DE); Otto Ferber, Germering (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 10/355,459

(22) Filed: Jan. 31, 2003

(65) Prior Publication Data

US 2003/0152400 A1 Aug. 14, 2003

(30) Foreign Application Priority Data

Feb. 5, 2002 (DE) ..... 102 04 640

(51) Int. Cl.[7] ..... G03G 15/16
(52) U.S. Cl. ..... 399/121
(58) Field of Search ..... 399/121, 116; 198/860.3, 866

(56) References Cited

U.S. PATENT DOCUMENTS 3,888,577 A 6/1975 Meyer
4,655,578 A * 4/1987 Kurtz et al.
4,811,839 A 3/1989 Cornell et al.
5,400,121 A 3/1995 Foote
5,708,924 A 1/1998 Shogren et al.
5,967,320 A * 10/1999 Cappels ..... 206/434
6,049,682 A 4/2000 Goetzke et al.
2003/0231898 A1 * 12/2003 Asaoka et al.

FOREIGN PATENT DOCUMENTS

EP 0 244 104 4/1987
EP 1 170 638 1/2002
JP 2003076216 A * 3/2003 ..... G03G/21/00
WO WO 98/39691 9/1998

OTHER PUBLICATIONS

Xerox Disclosure Journal—K. J. Buck—vol. 5, No. 4 Jul./Aug. 1980.

* cited by examiner

*Primary Examiner*—Arthur T. Grimley
*Assistant Examiner*—Ryan Gleitz
(74) *Attorney, Agent, or Firm*—Schiff Hardin LLP

(57) ABSTRACT

To be able to insert bands of an arbitrary length into a machine unit, for example intermediate carrier bands given an electrophotographic printer device, the band is seated on tubes. The tubes are pushed into receptacles arranged in the machine unit. The band can then be slipped over the transport and guide drums arranged in the machine unit. Subsequently, the band is tensed and the tubes are pulled from the receptacles.

18 Claims, 5 Drawing Sheets

DEVICE FOR INSERTING A BAND INTO A MACHINE UNIT

BACKGROUND OF THE INVENTION

Bands, particularly thin endless bands, are employed in the greatest variety of applications. For example, thin plastic bands are utilized (WO 98/39691) for the image development, image transfer as well as for the transport of toner in modern electrophotographic printers. The bands run in corresponding machine units (for example, electrophotography units or transfer band units) that are constructed of a band drive and band running regulating unit, rotatably seated deflection drums and/or stationary deflection rods and a tensing mechanism, among other things.

The bands are subject to wear and this necessitates replacement. The replacement should be able to be carried out by an operator having no special technical expertise. Expense and damage risk should thereby be as slight as possible. The possibility must likewise be established that the bands can be removed from the machine units for maintenance and reintroduced thereinto (likewise without risk of damage).

Different approaches have hitherto been disclosed for the insertion and removal of the bands from electrophotographic printers.

One solution is comprised in transporting the bands in shaping packaging (contour packaging). This contour packaging is put in place at the machine unit where the band is to be replaced, and the band can then be introduced from the packaging into the machine unit. Variations thereof are disclosed by the following patents: U.S. Pat. No. 4,811,839, U.S. Pat. No. 5,708,924, U.S. Pat. No. 6,049,682, U.S. Pat. No. 5,400,121.

Solutions are also applied wherein the operator—after slight relaxation of the band in the machine unit—must thread the new band into the machine. This, however, is only possible given bands with a small circumference.

SUMMARY OF THE INVENTION

It is an object of the invention to specify a simply constructed device with which an operator may insert a band, particularly a longer band, into a machine unit without the presence of any risk of damage to the band and without requiring technical expertise.

According to the system and method of the present invention, a band is inserted into a machine unit. At least two tubes which serve to seat the band are inserted into receptacles arranged in the machine unit such that the band assumes an approximate contour that it will have in the machine unit. Subsequently the band is pushed into the machine unit so that the band slides off the tubes and into the machine unit. Subsequently, the tubes are pulled from the receptacles.

To remove a band from a machine unit, the band is relaxed and tubes are also pushed into receptacles of the machine unit. The band is then pulled off the machine unit and onto the tubes. Tubes are pulled from the receptacles so that the band is thus removed from the machine unit.

The invention is explained in greater detail on the basis of an exemplary embodiment that is shown in the Figures.

DESCRIPTION OF THE PREFERRED EMBODIMENT

Figure 1:
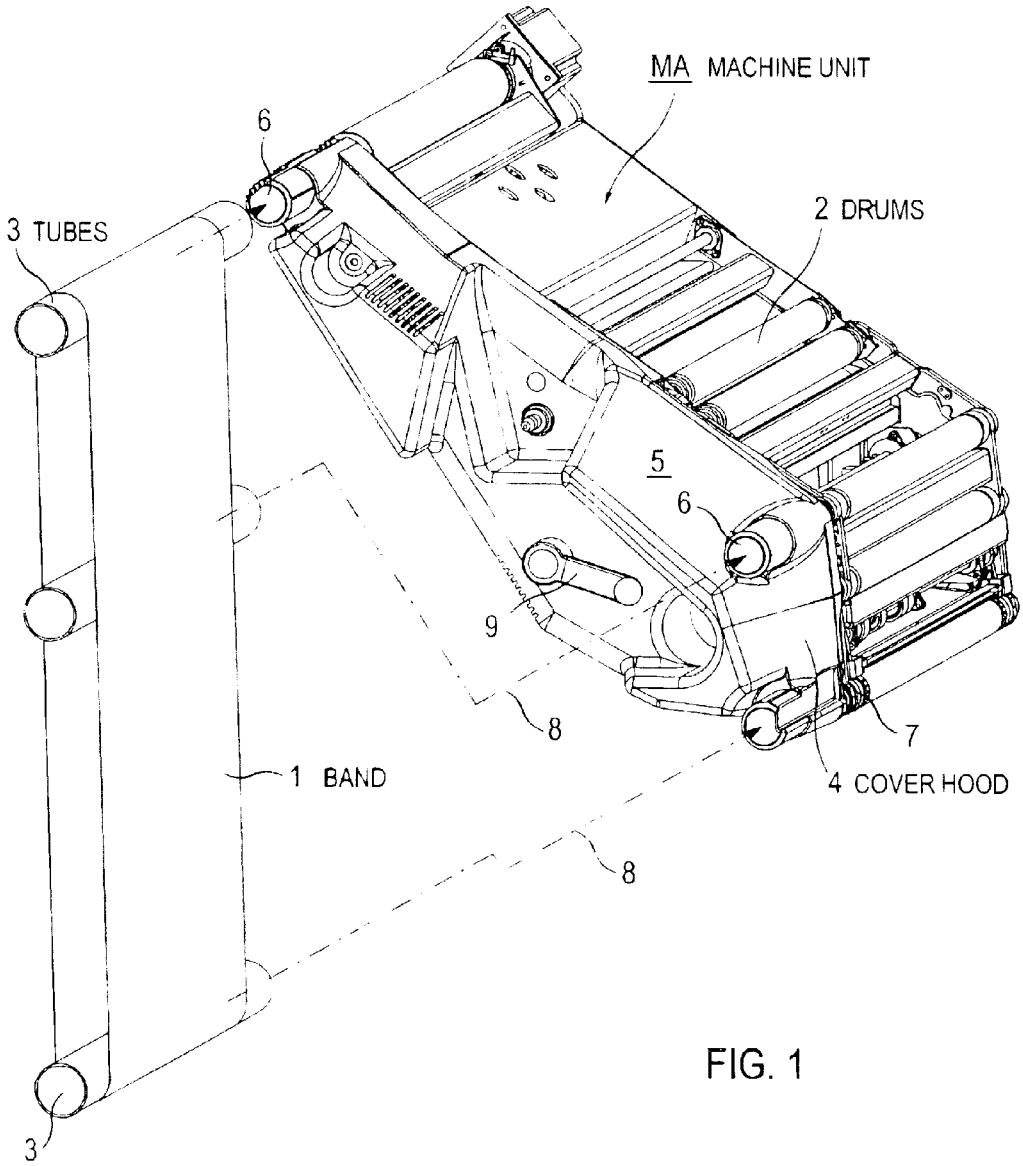
FIG. 1 shows the band seated on the tubes, said band to be slipped onto the machine unit.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

The solution differs from known insertion devices by its simplicity. Due to the simplicity (producing the contour step-by-step), a very dependable device for the sensitive plastic bands is made available in a cost-beneficial and environmentally friendly way (for example, multiple use of a space-saving packaging).

Another advantage of the solution is that it can be employed in the same way for machine units having different contours.

There is also the possibility that bands that, for example, are taken from a printer and are to be reemployed can be placed into a packaging by the operator damage-free in the reverse sequence of the insertion process.

For facilitation, a cover hood can be arranged at the side of the machine unit from which the band is slipped on, the edges of said cover hood being potentially implemented conically and smooth, so that the band can slide there over without damage.

When the band is guided in the machine unit via drums and/or deflection rods, it is expedient to arrange component parts with a crowned (rounded) and smooth surface between the cover hood and the drums/deflection rods. A pinching or entanglement of the band upon insertion is thus avoided.

The tubes can be cost-advantageously manufactured of cardboard.

An important area of employment for the device is electrophotographic printing. For example, bands are employed therein for the transport of toner images, as disclosed by WO 98/39691. The replacement of these bands can occur quickly, without damage to the band and without making the operator dirty.

For inserting the band, the operator pushes the tube on which the band is seated into the receptacles provided in the machine unit. The contour of the band is thus fixed in conformity with the contour thereof. Upon insertion of the band, the band slides over the cover hood and the component parts onto the drums/deflection rods of the machine unit.

For removing a band arranged in the machine unit from the machine unit, the band is pulled onto the tube arranged in the receptacles, whereby the band slides onto the tube. The tube together with the band can then be withdrawn.

FIG. 1 shows a machine unit MA that, for example, can be the transport device for an intermediate carrier band in an electrophotographic printer or copier device (WO 98/39691). The explanation only mentions those parts of the machine unit MA that play a part in the insertion of the band 1. The parts of the machine unit MA have the standard structure and can be derived from the aforementioned Letters Patents, which are incorporated herein.

The machine unit MA comprises drums 2 over which the band 1 is conducted. These drums 2 partly drive the band 1 or serve only for the deflection of the band 1. In order to be able to slip the band 1 onto the drums, the band must assume a contour that, for example, is defined by the position of the drums 2.

The band 1 is now to be inserted into the machine unit MA, this band being seated on tubes 3. The band, for example, can be arranged in a packaging (not shown) and can be removed therefrom lying on the tubes 3. For example, three tubes 3 can be employed.

At that side from which the band 1 is to be slipped on, the machine unit MA is provided with a cover hood 4. This is implemented conically and smoothly at the edges 5 over which the band is supposed to slide. The cover hood 4 also comprises receptacles 6 into which the tubes 3 can be slipped. The receptacles can also be arranged in the machine unit itself.

Component parts 7 that comprise a crowned and smooth surface are arranged between cover hood 4 and the drums 7.

The insertion event is explained on the basis of FIGS. 2–5, which show the executive sequence step-by-step.

FIG. 1 shows the first step of the insertion. The band 1 that, for example, has been removed from a packaging is seated on the tubes 3 and is to be inserted into the machine unit MA. For example, it is seated on three tunes 3 that are schematically shown. The machine unit MA has the structure shown in FIG. 1. The arrows 8 indicate how the tubes 3 are inserted into the receptacles 6. In the example of FIG. 1, the receptacles are arranged in the cover hood 4.

It can also be seen from FIG. 1 that bands having different lengths (for example, rated length +/−10 mm tolerance) can be unproblemmatically inserted into a machine unit MA according to the invention and that the expense therefor is slight.

Figure 2:
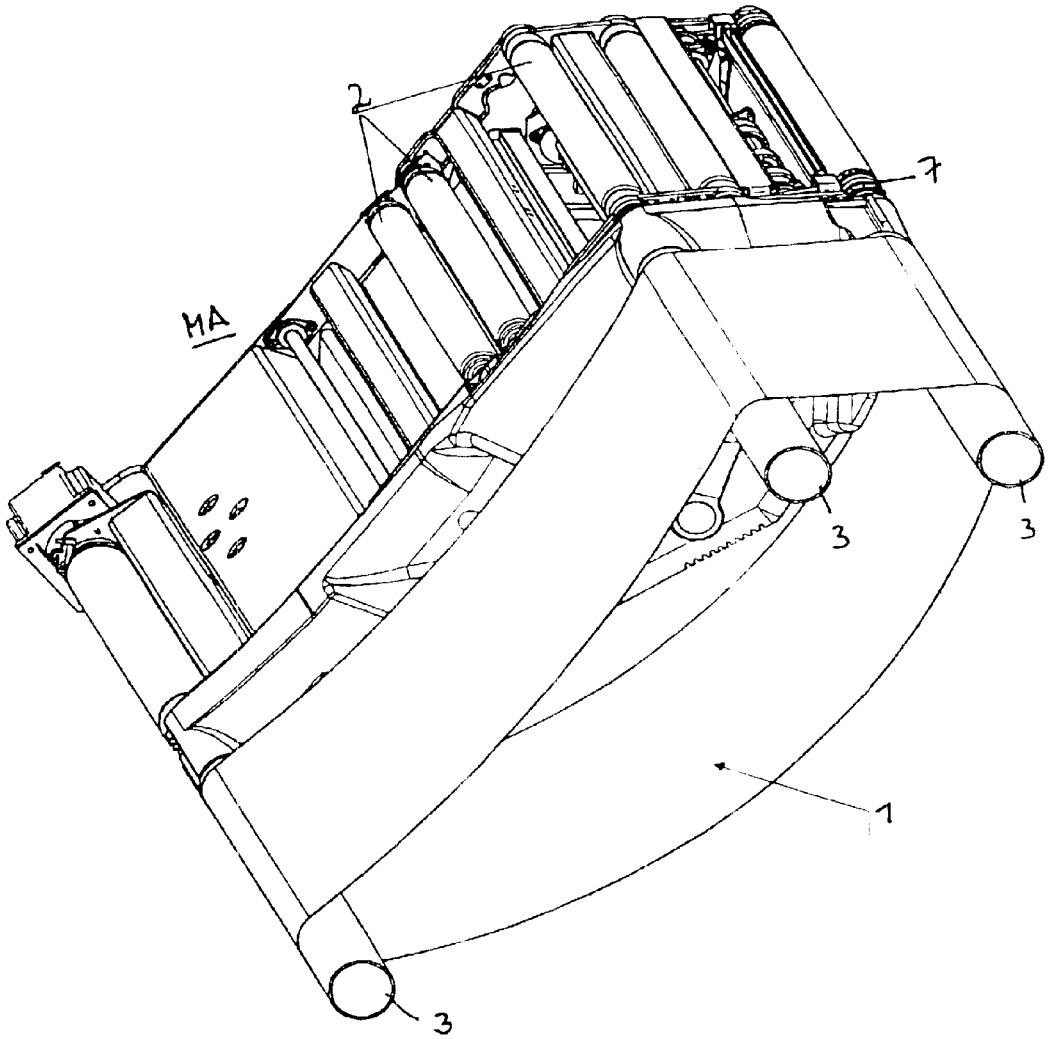
FIG. 2 shows the first step of the insertion wherein the tubes are pushed into the receptacles.
Figure 3:
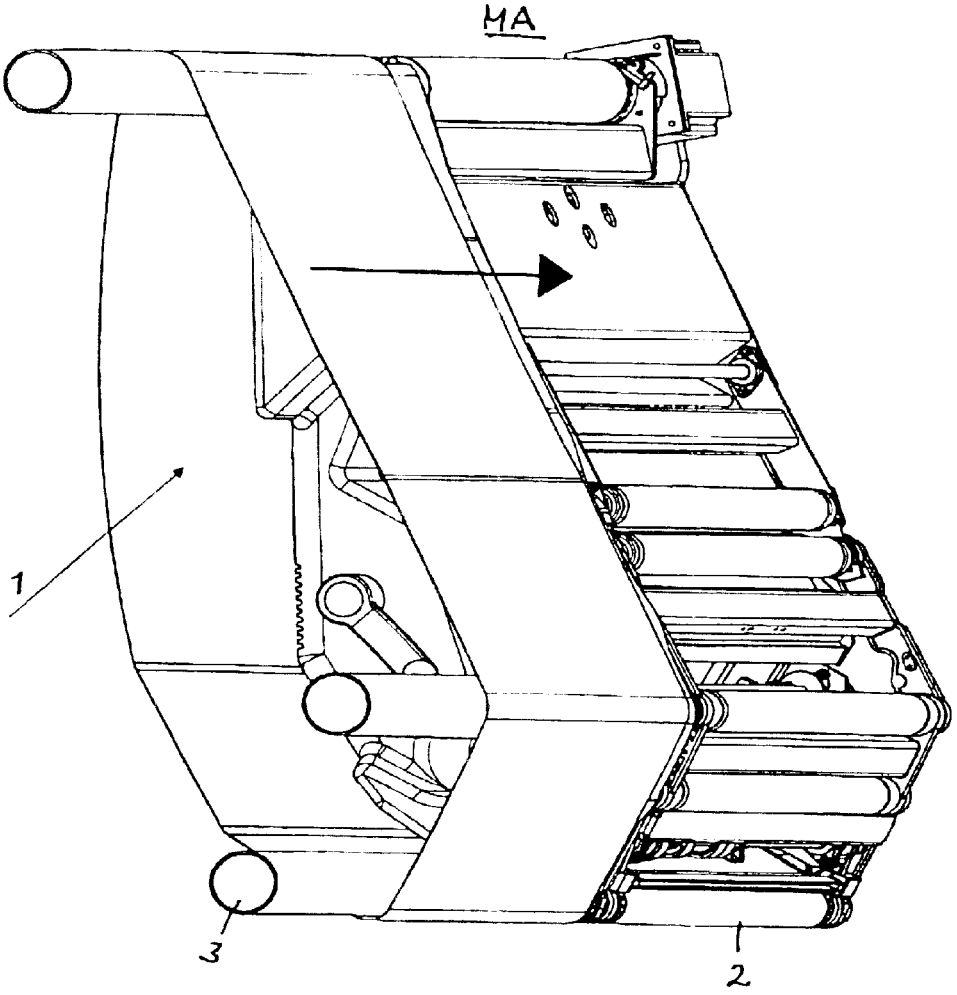
FIG. 3 illustrates the second step where the band slides over the cover hood.
Figure 4:
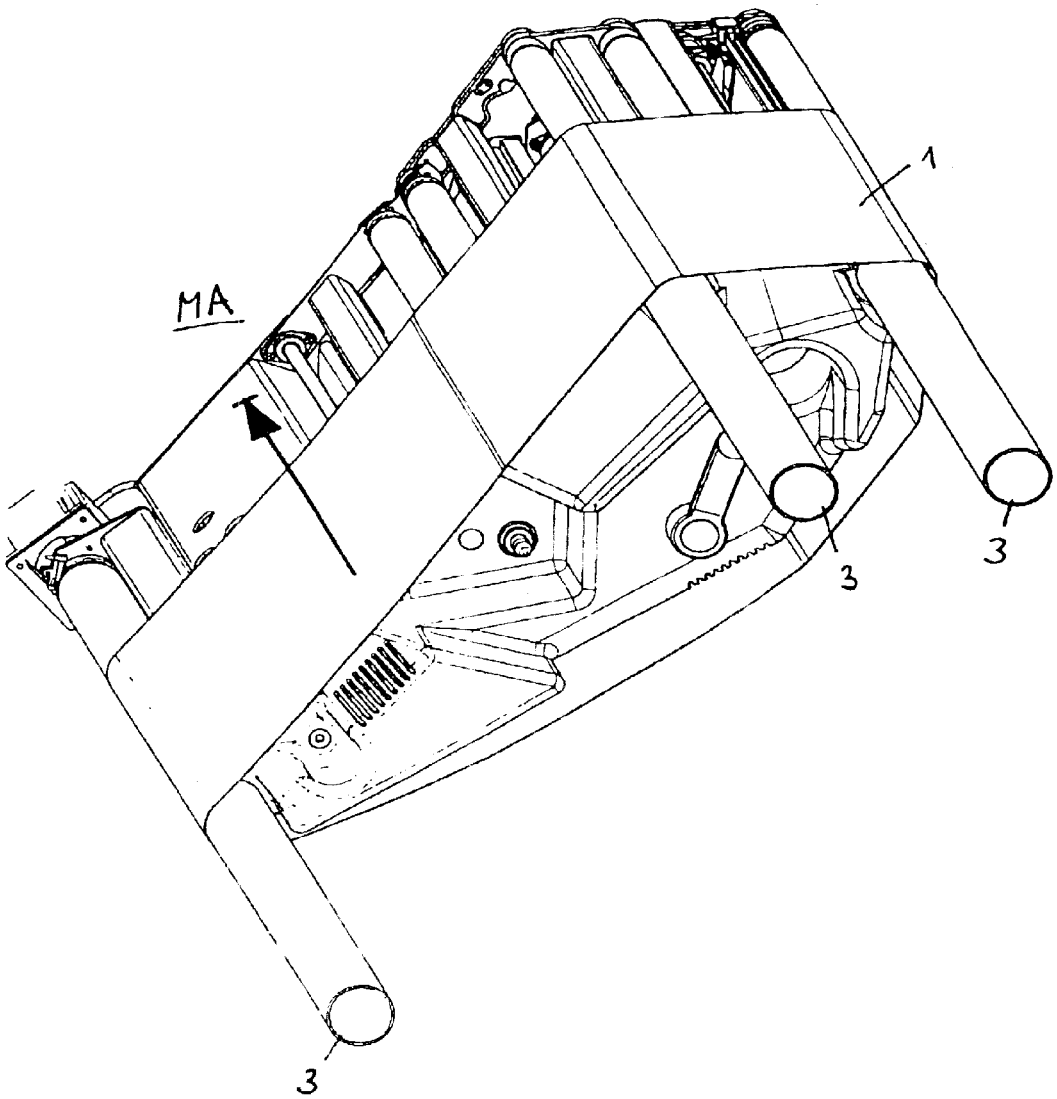
FIG. 4 shows the third step where the band slides with proper contour over the component parts onto the drums.

FIG. 2 shows the condition wherein the tubes 3 have begun to be pushed into the receptacles 6. The band 1 is pre-shaped due to the plugging of the tubes 3 into the receptacles, so that the contour required by the machine unit MA is already approximated.

In the next step (FIG. 3), the band 1 is slipped over the cover hood 4, whereby the band 1 assumes the contour of the machine unit MA.

Given further insertion (FIG. 4) onto the machine unit MA, the band slides onto the drums 2 of the machine unit MA. The insertion is facilitated by the component parts 7.

Figure 5:
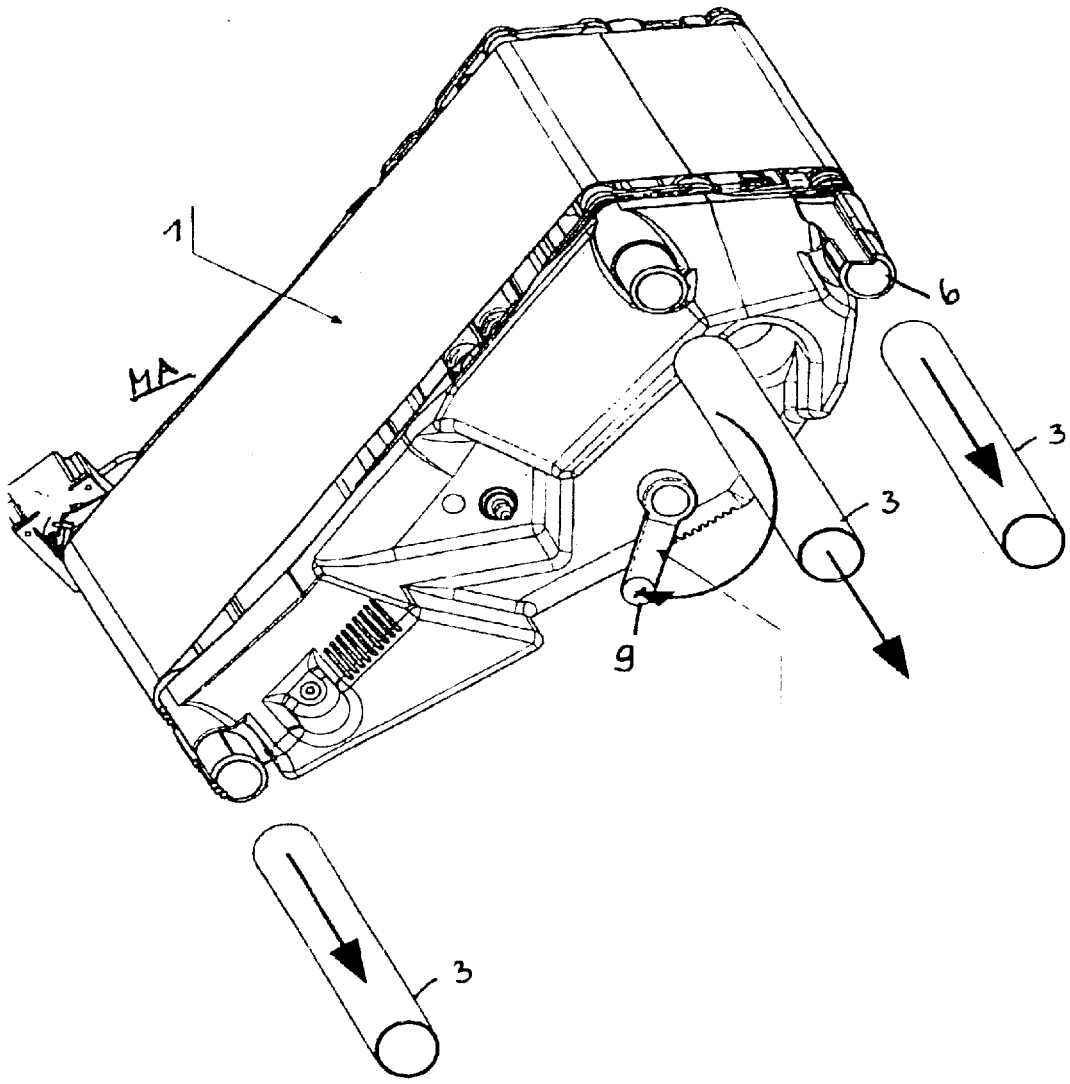
FIG. 5 illustrates the fourth step where the band has reached its final position.

Finally, the band 1 has reached its final position (FIG. 5). The band is tensed with the assistance of the tensing mechanism 9. The tubes 3 can be subsequently withdrawn.

The removal of a band 1 from the machine unit MA occurs in the described way but in the reverse sequence. I.e., the band is first relaxed, the tubes 3 are then pushed into the receptacles 6, and the band 1 is subsequently pulled onto the tubes 3 and then removed together with the tubes 3.

The system is suited for the insertion and replacement of extremely thin and very long bands. It is important that it can be employed for machine units with different geometry, and thus a different contour. The device is also very simple to handle While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim as our invention:

1. A system for inserting a band into a machine unit, comprising:

the band being seated on at least two independent tubes not connected to each other; and the machine unit comprises receptacles into which the tubes are plugged, and the band assumes a contour that the band has in the machine unit so that the band merely has to be pushed off the tubes and into the machine unit for the insertion of the band.

2. The system according to claim 1 wherein the machine unit comprises a cover hood at a side from which the band is slipped, on edges of said cover hood being implemented at least one of conical and smooth so that the band can slide there over.

3. The system according to claim 2 wherein the receptacles are arranged in the cover hood.

4. The system according to claim 2 wherein the machine unit comprises drums for guidance of the band, and component parts having at least one of a crowned and smooth surface are arranged between the cover hood and the drums.

5. The system according to claim 4 wherein the component parts are implemented one of spherical and barrel-shaped.

6. The system according to claim 1 wherein the tubes comprise cardboard.

7. A system for inserting a band into an electrographic printer or copier device, comprising:

the band being seated on at least two independent tubes not connected to each other;

the device comprises receptacles into which the tubes are plugged, and the band assumes a contour that the band has in the device so that the band merely has to be pushed off the tubes and into the machine unit for the insertion of the band.

8. The device according to claim 7 wherein the band comprises an intermediate carrier band that transports toner images of characters to be printed to a transfer printing station.

9. The method according to claim 7 wherein the band is seated on at least two tubes after tubes are plugged into the receptacles.

10. The method according to claim 7 wherein the band is seated on the at least two tubes before the tubes are inserted into the receptacles.

11. A method for inserting a band into a machine unit, comprising the steps of:

inserting at least two independent tubes not connected to each other into receptacles arranged in the machine unit and providing the band on the two tubes such that the band assumes an approximate contour that it will have in the machine unit;

subsequently pushing the band off the tubes and into the machine unit so that the band slides into the machine unit and onto drums of the machine unit; and tensing the band with a tensing mechanism of the machine unit and subsequently pulling the tubes from the receptacles.

12. The method according to claim 11 wherein the tubes are inserted into the receptacles arranged in a cover hood of the machine unit and the band is pushed over the cover hood.

13. A method for removing a band arranged in a machine unit, comprising the steps of:

pushing independent tubes not connected to each other into receptacles of the machine unit and relaxing the band;

pulling the band onto the tubes; and pulling the tubes from the receptacles so that the band is removed from the machine unit.

14. A method for inserting a band into a machine unit, comprising the steps of:

inserting at least two independent tubes not connected to each other into receptacles arranged in the machine unit and supporting the band with the at least two tubes so that the band assumes an approximate contour that it will have in the machine unit;

pushing the band off the tubes and into the machine unit; and pulling the tubes off the receptacles.

15. The method according to claim 14 wherein the band is tensed after it is in position on the machine unit.

16. The method according to claim 14 wherein the machine unit comprises an electrophotographic printer or copier device.

17. The method according to claim 14 wherein the band is placed on the tubes before they are inserted into the receptacles.

18. The method according to claim 14 wherein the band is placed on the tubes after they have been inserted into the receptacles.

* * * * *